US009963316B2

(12) United States Patent
Noso et al.

(10) Patent No.: US 9,963,316 B2
(45) Date of Patent: May 8, 2018

(54) SHEET STACKING TRAY, AND SHEET POSTPROCESSING DEVICE/IMAGE FORMING APPARATUS INCLUDING THE SHEET STACKING TRAY

(71) Applicant: KYOCERA Document Solutions Inc., Osaka (JP)

(72) Inventors: Terumitsu Noso, Osaka (JP); Sachio Izumichi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/490,404

(22) Filed: Apr. 18, 2017

(65) Prior Publication Data

US 2017/0305702 A1 Oct. 26, 2017

(30) Foreign Application Priority Data

Apr. 25, 2016 (JP) ..... 2016-086828

(51) Int. Cl.
*B65H 31/02* (2006.01)
*B65H 31/26* (2006.01)
(Continued)

(52) U.S. Cl.
CPC ..... *B65H 31/02* (2013.01); *B65H 29/52* (2013.01); *B65H 29/70* (2013.01); *B65H 31/26* (2013.01); *B65H 2301/4212* (2013.01); *B65H 2301/5122* (2013.01); *B65H 2301/51214* (2013.01); *B65H 2402/10* (2013.01); *B65H 2404/61* (2013.01); *B65H 2405/1111* (2013.01); *B65H 2405/1113* (2013.01); *B65H 2405/1115* (2013.01); *B65H 2405/11151* (2013.01);
(Continued)

(58) Field of Classification Search
CPC . B65H 31/02; B65H 31/26; B65H 2405/1111; B65H 2405/1113
See application file for complete search history.

(56) References Cited

U.S. PATENT DOCUMENTS 6,260,843 B1 * 7/2001 Hoshimura ..... B65H 31/02 271/162
6,550,763 B2 * 4/2003 Gordon ..... B65H 31/26 271/189
(Continued)

FOREIGN PATENT DOCUMENTS

JP 7-137915 A 5/1995
JP 2004-175480 A 6/2004

*Primary Examiner* — Patrick Cicchino
(74) *Attorney, Agent, or Firm* — Stein IP, LLC

(57) ABSTRACT

A sheet stacking tray includes a first stacking portion, a second stacking portion, and a base portion. In a sheet widthwise direction perpendicular to the sheet discharge direction, the first stacking portion includes a first sheet stacking surface having a first stacking width within a range from one half of a sheet width of a maximum-size sheet to be discharged up to the sheet width of the maximum-size sheet. The second stacking portion includes a second sheet stacking surface having a second stacking width smaller than the first stacking width. A border between the first stacking portion and the second stacking portion lies on a discharge-direction upstream side of a contact point where a leading end portion of the maximum-size sheet comes into contact with the sheet stacking part while the sheet is discharged.

8 Claims, 7 Drawing Sheets

(51) Int. Cl.
*B65H 29/70* (2006.01)
*B65H 29/52* (2006.01)

(52) U.S. Cl.
CPC ..... *B65H 2405/31* (2013.01); *B65H 2801/06* (2013.01); *B65H 2801/27* (2013.01)

(56) References Cited

U.S. PATENT DOCUMENTS

| | | | | |
|---|---|---|---|---|
| 6,634,640 | B1 * | 10/2003 | Yoshizawa | B65H 31/22 271/213 |
| 7,484,729 | B2 * | 2/2009 | Ono | B65H 31/02 271/207 |
| 8,820,742 | B2 * | 9/2014 | Koyanagi | B65H 31/24 271/224 |
| 9,527,695 | B2 * | 12/2016 | Kotaka | B41J 2/16508 |
| 9,723,160 | B2 * | 8/2017 | Xie | H04N 1/00554 |
| 2005/0201793 | A1 * | 9/2005 | Satozaki | G03G 15/6552 399/405 |
| 2015/0246560 | A1 * | 9/2015 | Nakamura | B65H 29/68 271/182 |
| 2016/0282803 | A1 * | 9/2016 | Osaki | G03G 21/1647 |
| 2017/0108815 | A1 * | 4/2017 | Yoneda | B65H 29/12 |

* cited by examiner

SHEET STACKING TRAY, AND SHEET POSTPROCESSING DEVICE/IMAGE FORMING APPARATUS INCLUDING THE SHEET STACKING TRAY

INCORPORATION BY REFERENCE

This application is based upon and claims the benefit of priority from the corresponding Japanese Patent Application No. 2016-086828 filed on Apr. 25, 2016, the entire contents of which are incorporated herein by reference.

BACKGROUND

The present disclosure relates to a sheet stacking tray which is mounted on an image forming apparatus such as copiers and printers and on which sheets to be discharged are stacked, the disclosure further relating to a sheet postprocessing device, as well as an image forming apparatus, including the sheet stacking tray.

Image forming apparatuses such as copiers and laser printers are equipped with a sheet (paper) discharge tray in order to discharge a sheet on which a desired image has been formed by electrophotographic process or to discharge a document which has been conveyed up to a document reading part by a document conveyance unit and subjected to a reading process of a document image.

For such a sheet discharge tray, it has conventionally been the case that a noren-like sheet presser member (a noren is a Japanese shop-front curtain partly slit for easier entrance) is placed at a sheet discharge opening to suppress curling of a discharged sheet which could occur to widthwise both-end portions of the sheet. Then, unfortunately, the discharged sheet may be directed downward by the sheet presser member, so that a forward end portion of the sheet may come into contact with a top surface of the sheet discharge tray as the forward end portion of the sheet is in a generally vertically erect state or is curled toward a wall surface provided on the upstream side in the discharge direction. When the sheet is further discharged up to its rear end portion in this state, there would be a fear that the sheet is discharged with its upside down or in a rounded state.

This being the case, there has been known a method, for example, in which a member for imparting stiffness to the sheet by making contact therewith is provided at a sheet discharge opening so as to suppress rounding or inversion of the sheet.

SUMMARY

A sheet stacking tray according to one aspect of the present disclosure includes a first stacking portion, a second stacking portion, and a base portion. The first stacking portion is placed on an upstream side of a discharged sheet in a sheet discharge direction, and has an upgrade along the sheet discharge direction. The second stacking portion extends on a discharge-direction downstream side of the first stacking portion, and is horizontal or has an upgrade smaller than that of the first stacking portion along the sheet discharge direction. The base portion has the first stacking portion and the second stacking portion provided therein. In a sheet widthwise direction perpendicular to the sheet discharge direction, the first stacking portion includes a first sheet stacking surface having a first stacking width within a range from one half of a sheet width of a maximum-size sheet to be discharged up to the sheet width of the maximum-size sheet. The second stacking portion includes a second sheet stacking surface having a second stacking width smaller than the first stacking width. A border between the first stacking portion and the second stacking portion lies on a discharge-direction upstream side of a contact point where a leading end portion of the maximum-size sheet comes into contact with the sheet stacking part while the sheet is discharged.

Still further objects of the disclosure as well as concrete advantages obtained by the disclosure will become more apparent from embodiments thereof described hereinbelow.

DETAILED DESCRIPTION

Figure 1:
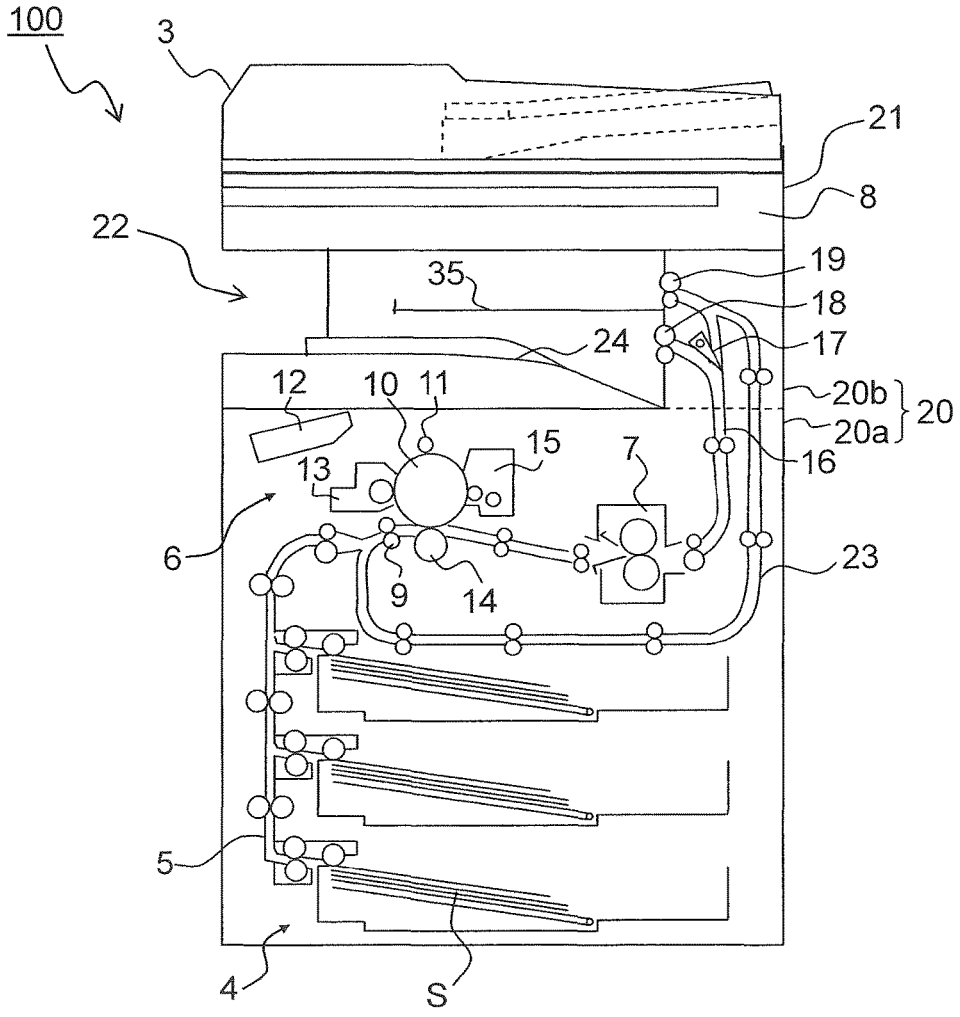
FIG. 1 is a schematic sectional view of an image forming apparatus on which a sheet discharge tray according to the present disclosure is mounted.

Hereinbelow, an embodiment of the present disclosure will be described in detail with reference to the accompanying drawings. FIG. 1 is a schematic view showing an internal structure of an image forming apparatus 100 on which a sheet discharge tray 24 according to this disclosure is mounted. As shown in FIG. 1, the image forming apparatus 100, which is a digital multifunction peripheral of the so-called in-body paper discharge type, is composed roughly of a main housing 20 and an upper housing 21 provided on top of the main housing 20.

The main housing 20 is composed of a lower housing 20*a*, and a coupling housing 20*b* which is located along a right side portion of FIG. 1 over the lower housing 20*a* and coupled with the upper housing 21. In the lower housing 20*a*, provided are a sheet (paper) feed part 4 set in lower part, a sheet conveyance part 5 set sideward and upward of the sheet feed part 4, an image forming part 6 set upward of the sheet feed part 4, and a fixing part 7 set on the downstream side (right side in FIG. 1) of the image forming part 6 in the sheet conveyance direction. In the coupling housing 20*b*, a sheet discharge part for conveying a fixing-processed sheet S and discharging the sheet S out of the main housing 20 is provided. Also, an in-body discharge space 22 largely opened toward the left side face and the front face is formed left-hand sideward of the coupling housing 20*b* beneath the upper housing 21.

The image forming part 6 is to form a specified toner image on the sheet S by electrophotographic process. The image forming part 6 includes a photosensitive drum 10 which is an image carrier pivotally held so as to be rotatable, as well as a charging unit 11, an exposure unit 12, a developing unit 13, a transfer unit 14, a cleaning unit 15, and an unshown charge eliminating unit which are set around the photosensitive drum 10 and along its rotational direction.

In the upper housing 21, an image reading part 8 is provided. The image reading part 8 is to read image information as to a document. For reading of a document on a sheet-by-sheet basis by the image reading part 8, a document conveyance unit 3 is opened and then the document is mounted on a contact glass (not shown) provided on top of the upper housing 21. For automatic reading of a document bundle by the image reading part 8, the document bundle is mounted on a sheet feed tray of the closed document conveyance unit 3. After this setting, document sheets are fed onto the contact glass one by one automatically and successively from the document bundle.

A basic operation of the image forming apparatus 100 constituted as described above will be described below. First, a surface of the photosensitive drum 10 that rotates counterclockwise in FIG. 1 is uniformly electrically charged by the charging unit 11. Then, on a basis of image information subsequently read by the image reading part 8, a light beam from the exposure unit 12 is applied to the circumferential surface of the photosensitive drum 10. As a result of this, an electrostatic latent image is formed on the surface of the photosensitive drum 10. Toner as a developer is supplied from the developing unit 13 to the resulting electrostatic latent image, by which a toner image is formed.

In parallel with the formation of the toner image, a sheet S is fed out from the sheet feed part 4 onto the sheet conveyance part 5, being stopped once at a registration roller pair 9. The sheet S stopped at the registration roller pair 9 is conveyed at a specified timing toward the photosensitive drum 10 with the toner image formed thereon. Then, the toner image on the surface of the photosensitive drum 10 is transferred onto the sheet S by the transfer unit 14 made up of a transfer roller and the like. The sheet S with the toner image transferred thereon is separated from the photosensitive drum 10 and conveyed toward the fixing part 7. The sheet S, while passing through the fixing part 7, is subjected to a heating and pressurizing process, so that the toner image is fixed on the sheet S.

With regard to the photosensitive drum 10 that has completed the transfer process of the toner image onto the sheet S, residual toner remaining on the circumferential surface of the photosensitive drum 10 is removed by the cleaning unit 15. Next, a charge elimination process of eliminating residual charge is performed by a charge eliminating unit (not shown). Thereafter, a charging process for the circumferential surface is applied again by the charging unit 11, followed by execution of the image formation process in the same way as described above.

The sheet S having passed through the fixing part 7 is conveyed into the coupling housing 20*b* along a vertical conveyance path 16 which is directed subsequently vertically upward. An upper portion of the vertical conveyance path 16 is branched leftward into upper-and-lower two conveyance paths within the coupling housing 20*b*. The sheet S guided to the lower conveyance path by a switch guide 17 placed at the branch portion is discharged leftward from first discharge roller pairs 18, and stocked on a sheet discharge tray 24 formed at the bottom of the in-body discharge space 22. Meanwhile, the sheet S guided to the upper conveyance path by the switch guide 17 is discharged leftward from second discharge roller pairs 19 onto a second sheet discharge tray 35.

Figure 2:
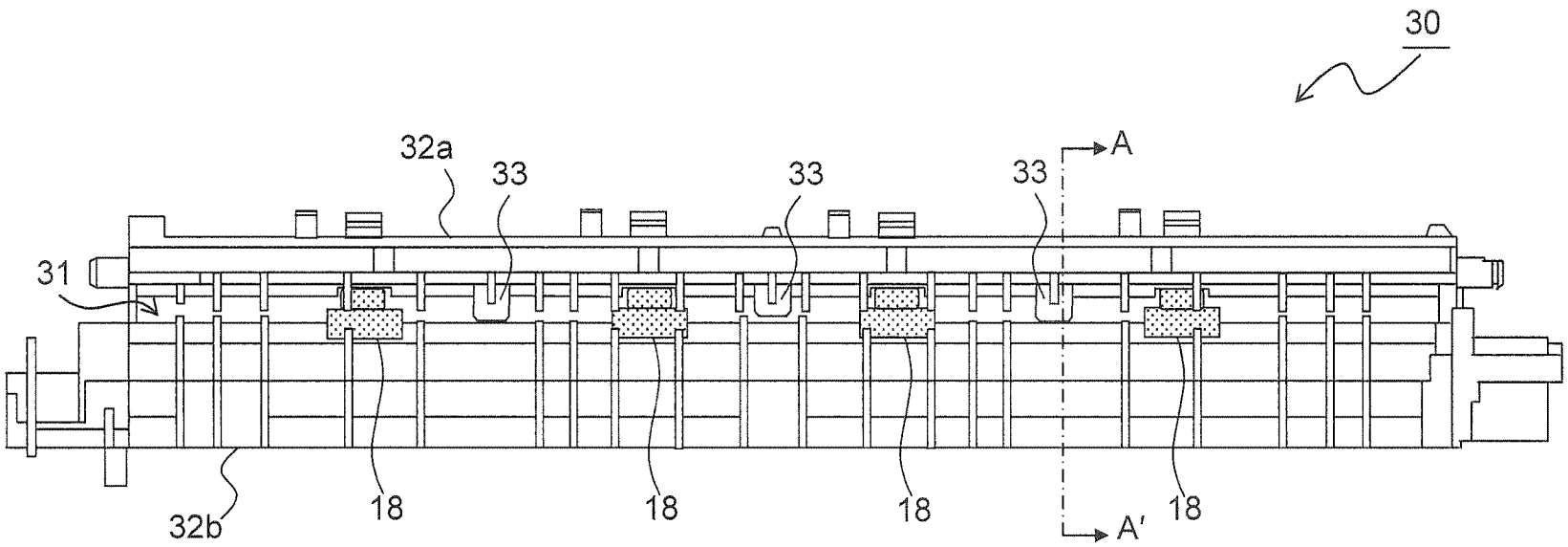
FIG. 2 is a front view of a sheet discharge unit to be mounted on the image forming apparatus as viewed from a downstream side in a sheet discharge direction.
Figure 3:
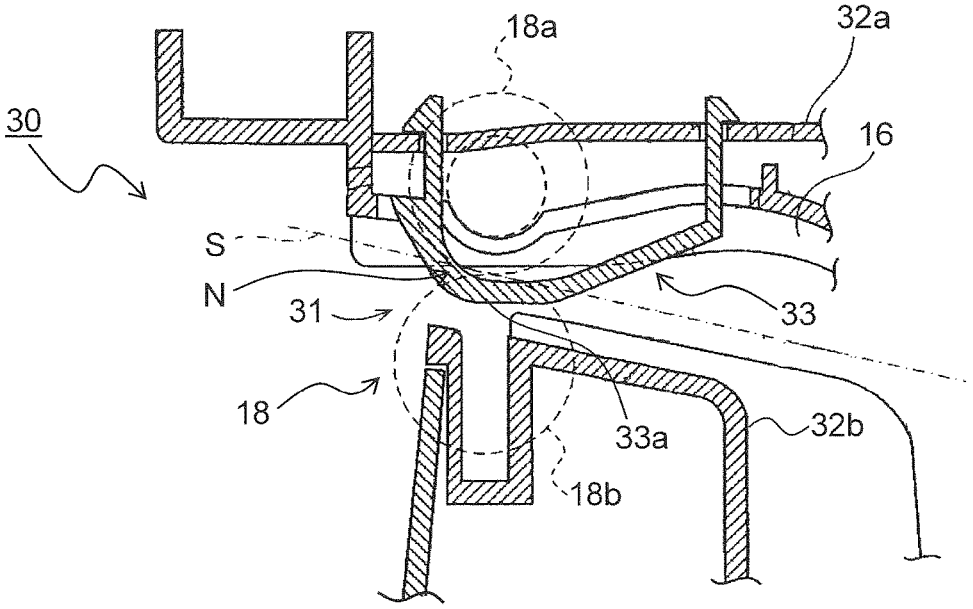
FIG. 3 is a side sectional view of the sheet discharge unit.

FIG. 2 is a front view of a sheet discharge unit 30 to be mounted on the image forming apparatus 100 as viewed from a downstream side (left side in FIG. 1) in a sheet discharge direction. FIG. 3 is a side sectional view of the sheet discharge unit 30 (a sectional view taken along the line A-A' of FIG. 2). The sheet discharge unit 30 (sheet discharge part) includes a sheet discharge opening 31, an upper conveyance guide 32*a* and a lower conveyance guide 32*b* for guiding a sheet to the sheet discharge opening 31, first discharge roller pairs 18, and corrugation members 33.

The first discharge roller pairs 18, counting four pairs, are disposed generally equidistantly in the sheet widthwise direction (left/right direction in FIG. 2) in upstream-side proximity to the sheet discharge opening 31 so as to discharge a sheet, which has been conveyed along the vertical conveyance path 16, to the sheet discharge tray 24 (see FIG. 3). Each of the first discharge roller pairs 18 is composed of a rubber-made discharge roller 18*a* rotatable forward and reverse by a drive motor (not shown), and a resin-made discharge roller 18*b* which is rotated subordinate to the discharge roller 18*a*.

Between each two of the first discharge roller pairs 18, provided is a corrugation member 33 for pressing a top surface of the sheet discharged from the sheet discharge opening 31. The corrugation members 33 are supported by the upper conveyance guide 32*a* so as to be vertically movable while being biased downward by compression spring (not shown).

The sheet S discharged from the sheet discharge opening 31 is nipped by nip portions N of the first discharge roller pairs 18 while being pressed downward below the nip portions N by lower end portions 33*a* of the corrugation members 33. As a result, the sheet S is discharged onto the sheet discharge tray 24 as it has been flexed in a corrugated shape as viewed in the discharge direction and moreover it has been given stiffness. Thus, such a malfunction can be prevented that the sheet S is discharged with its forward end sagged downward due to its self weight and, as a result, the sheet S has its forward end struck and caught on the top surface of the sheet discharge tray 24 so as to be stacked thereon in a rounded state.

Figure 4:
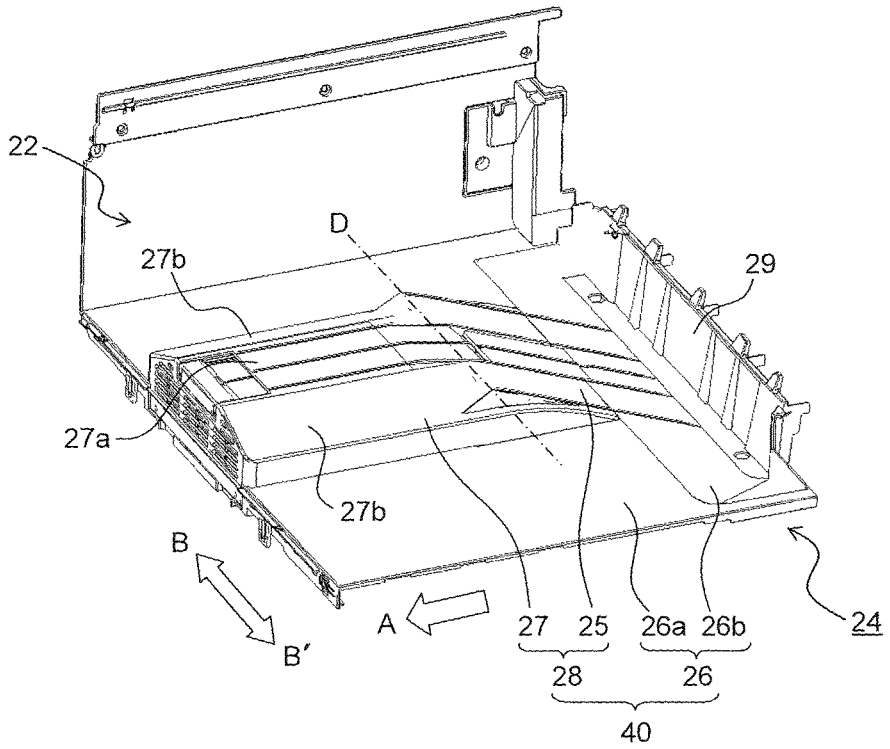
FIG. 4 is a perspective view showing a structure of the sheet discharge tray according to one embodiment of the disclosure.
Figure 5:
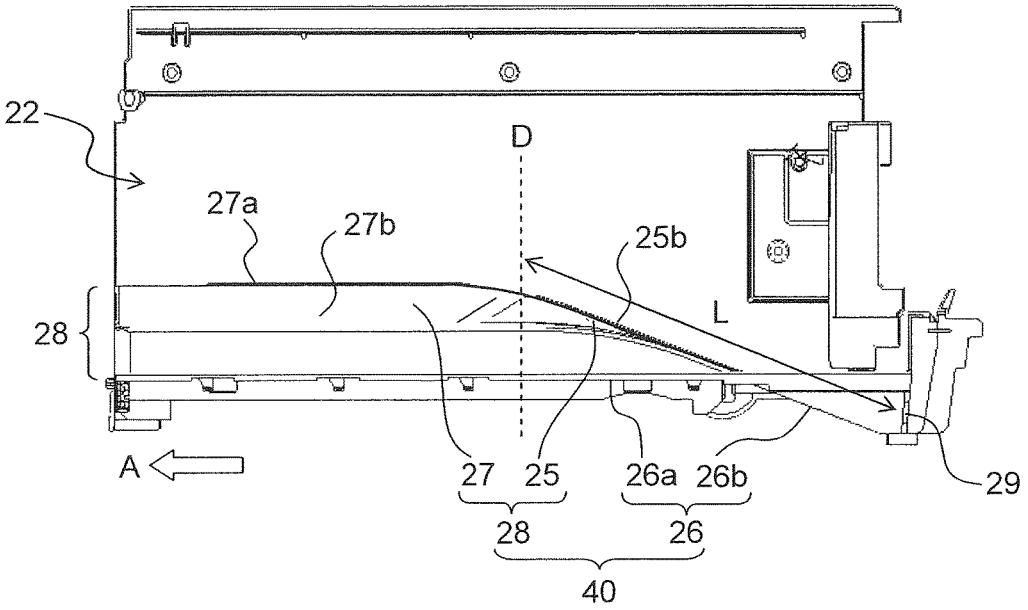
FIG. 5 is a side view of the sheet discharge tray of the embodiment as viewed from the front side of the image forming apparatus.
Figure 6:
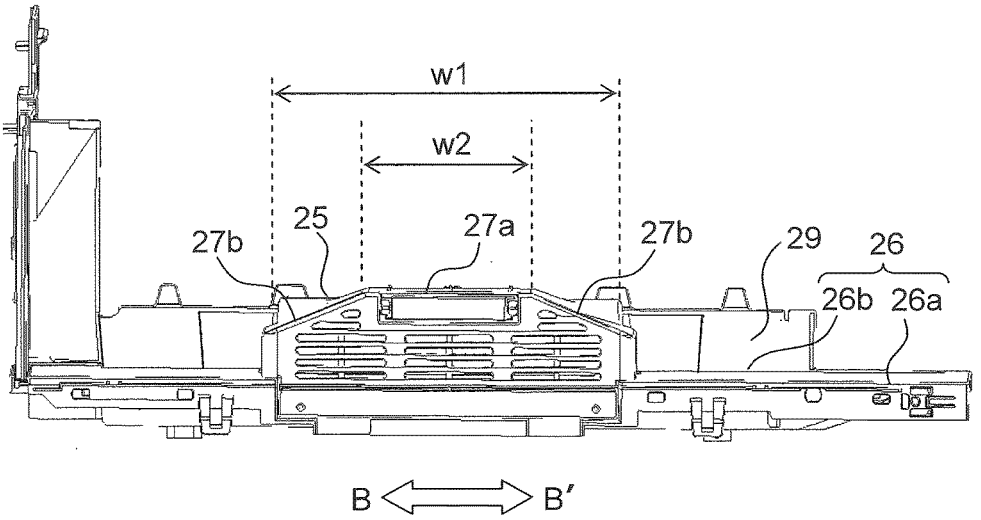
FIG. 6 is a side view of the sheet discharge tray of the embodiment as viewed from the downstream side in the discharge direction.

FIG. 4 is a perspective view showing a structure of the sheet discharge tray 24 according to one embodiment of the disclosure. FIGS. 5 and 6 are side views of the sheet discharge tray 24 of the embodiment as viewed from the front side (viewer side in FIG. 1) and the discharge-direction downstream side (left side in FIG. 1), respectively. As shown in FIG. 4, the sheet discharge tray 24 includes a first stacking portion 25, a base portion 26, a second stacking portion 27, and a rear wall portion 29. For discharge of a sheet S having a length ranging beyond the first stacking portion 25 up to the second stacking portion 27, the first stacking portion 25 supports a generally rear portion (discharge-direction upstream side) of the sheet discharged from the sheet discharge unit 30. The second stacking portion 27 supports a generally front portion (discharge-direction downstream side) of the discharged sheet. For discharge of a sheet S having a length shorter than the first stacking portion 25, the first stacking portion 25 supports a generally entirety of the discharged sheet. The base portion 26 includes a flat part 26*a* for supporting the first stacking portion 25 and second stacking portion 27, and a base end portion 26*b* which is inclined downward from the flat part 26*a* toward the discharge-direction downstream side. The rear wall portion 29 anchors a rear end of a stacked sheet so as to make the sheet aligned. The first stacking portion 25, the base portion 26, and the second stacking portion 27 make up a sheet stacking part (paper stacking part) 40 of the sheet discharge tray 24.

The first stacking portion 25 (first sheet stacking surface) is formed so as to be upgrade from the rear wall portion 29 along the discharge direction (arrow A direction). The base end portion 26*b* of the base end portion 26, which is formed together with the rear wall portion 29 so as to be integrally formed with the sheet discharge tray 24, is coupled with the discharge-direction upstream side of the first stacking portion 25.

The second stacking portion 27 is provided so as to extend generally horizontally on the discharge-direction downstream side of the first stacking portion 25. The second stacking portion 27 has a sheet stacking surface 27*a* (second sheet stacking surface) formed generally horizontal, and sloped surfaces 27*b* formed so as to be sloped downward from both-end edges of the sheet stacking surface 27*a* in the sheet widthwise direction. As a result, the sheet stacking part 40 of the sheet discharge tray 24 is formed into a bent shape which peaks near a border D between the first stacking portion 25 and the second stacking portion 27.

The second stacking portion 27 is integrally formed with the first stacking portion 25 so as to make up, in combination with the first stacking portion 25, a sheet stacking member 28 which is fittable to and removable from the sheet discharge tray 24. When a sheet postprocessing unit (paper postprocessing unit, not shown) for performing punch-hole forming process or binding process (postprocessing) with a sheet over the image formation process is set up in the in-body discharge space 22, the sheet postprocessing unit is inserted into the in-body discharge space 22 with the sheet stacking member 28 removed.

As shown in FIG. 5, a length L equal to a total length of the first stacking portion 25 and the base end portion 26 in the discharge direction (arrow A direction) (i.e., a distance from rear wall portion 29 to border D) is set to one half or less of a discharge-direction sheet length of a maximum-size sheet S which is to be discharged from the sheet discharge unit 30 and stacked on the sheet discharge tray 24.

As shown in FIG. 6, a size (first stacking width w1) of the first stacking portion 25 in the sheet widthwise direction (arrow BB' direction) is set to within a range from one half of a sheet width of a maximum-size sheet S up to the sheet width of the maximum-size sheet S, where the sheet S is to be discharged from the sheet discharge unit 30 and stacked on the sheet discharge tray 24. Also, a size (second stacking width w2) of the sheet stacking surface 27*a* of the second stacking portion 27 in the sheet widthwise direction (arrow BB' direction) is set smaller than the size w1 of the first stacking portion 25 in the sheet widthwise direction.

Figure 7:
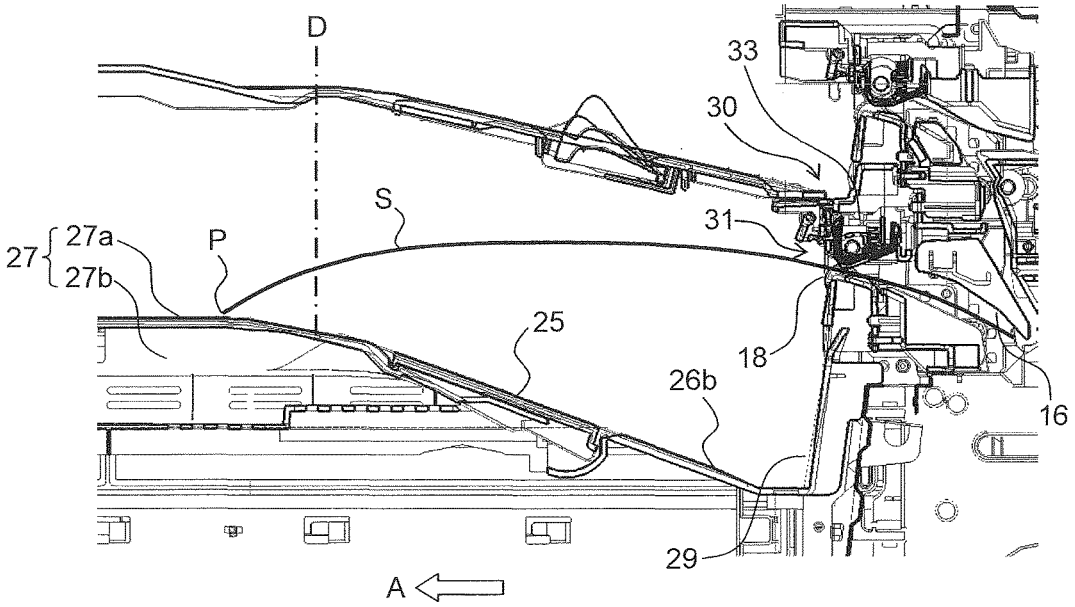
FIG. 7 is a side sectional view of an aspect in which a sheet is discharged onto the sheet discharge tray, as viewed from the front side of the image forming apparatus.

FIG. 7 is a side sectional view of an aspect in which a sheet S is discharged from the sheet discharge opening 31 onto the sheet discharge tray 24, as viewed from the front side (viewer side in FIG. 1). As shown in FIG. 7, the sheet discharge tray 24 of this embodiment is so designed that the border D lies normally on the discharge-direction upstream side of a landing point (contact point) P of a forward end portion of the sheet S. As a result, the sheet S discharged from the sheet discharge opening 31 through the vertical conveyance path 16 has its forward end portion go beyond the border D and strike on the sheet stacking surface 27*a* of the second stacking portion 27.

In this case, since the second stacking width w2 of the sheet stacking surface 27*a* is smaller than the first stacking width w1 of the first stacking portion 25, the forward end portion of the sheet S that has landed on the sheet stacking surface 27*a* has its widthwise both-end portions flexed downward along the sloped surfaces 27*b* due to its self weight. By virtue of this, the forward end portion (discharge-direction downstream side) of the discharged sheet S is given stiffness. Also, widthwise both-end portions of the sheet S are supported along the sloped surfaces 27*b*. In addition, the sheet-widthwise size of the second stacking portion 27 containing the sheet stacking surface 27*a* plus the sloped surfaces 27*b* (i.e., a distance between both end portions of the sloped surfaces 27*b*) is generally equal to the sheet-widthwise size (first stacking width w1) of the first stacking portion 25.

The landing point P of the forward end portion of the sheet S varies depending on the size and stiffness of the sheet S discharged from the sheet discharge opening 31, the presence or absence of the corrugation members 33, and the like. Therefore, the length L of the total of the first stacking portion 25 and the base end portion 26*b* needs to be set such that the border D lies on the further upstream side of the landing point that is the discharge-direction most upstream-side (right side in FIG. 7) assumable one among landing points P of the sheet S.

More specifically, as shown in FIG. 5, the length L of the total of the first stacking portion 25 and the base end portion 26 in the discharge direction (arrow A direction) is set to one half or less of the discharge-direction sheet length of a maximum-size sheet S. As a result of this, the forward end portion of the maximum-size sheet S lands, normally beyond the border D, on the sheet stacking surface 27*a*.

The stacking width of the base end portion 26*b* to be coupled with the first stacking portion 25 is equal to or more than the sheet width of the maximum-size sheet S, and the first stacking width w1 of the first stacking portion 25 is equal to or more than the sheet width of the maximum-size sheet S. Therefore, the sheet S is stacked with the discharge-direction upstream side of the sheet S extended flat along the first stacking portion 25 and the base end portion 26. Thus, it is made possible to correctly stack the sheet S in position.

As described hereinabove, the sheet discharge tray 24 of this embodiment includes: a first stacking portion 25 having a sheet-widthwise stacking width within a range from one half of a sheet width of a maximum-size sheet S up to the sheet width of the maximum-size sheet S; and a second stacking portion 27 which extends on the downstream side of the first stacking portion 25 and which has a sheet-widthwise size of the sheet stacking surface 27*a* smaller than the sheet-widthwise size of the first stacking portion 25. With this constitution, regardless of the size of the sheet S, it is possible to impart a proper degree of stiffness to the forward end side (discharge-direction downstream side) of the discharged sheet S, so that alignment of a sheet to be stacked can be improved. Furthermore, it is no longer necessary to impart an intense degree of stiffness to the sheet S by means of the corrugation members 33, so that occurrence of stripes or flaws due to sliding contact between the corrugation members 33 and the image surface of the sheet S can be suppressed.

Also, the sheet stacking part 40 of the sheet discharge tray 24 is formed into a bent shape from the first stacking portion 25, which is upgrade along the discharge direction, and the second stacking portion 27, which is generally horizontal. Therefore, the sheet S discharged onto the sheet discharge tray 24 can be stacked stably along the bent shape. Further, by the arrangement that the length L from the rear wall portion 29 to the border D is set to one half or less of the discharge-direction sheet length of the maximum-size sheet S, the forward end of the sheet S can be landed securely onto the second stacking portion 27.

Still more, the first stacking width w1 of the first stacking portion 25, which forms part of the sheet stacking member 28 that is fittable/removable for the sheet discharge tray 24 in combination with the second stacking portion 27, is set equal to or less than the sheet width of the maximum-size sheet S. With this constitution, the size of the sheet stacking member 28 to be removed for process of fitting the sheet postprocessing device can be made as small as possible within such a range as does not disturb sheets' stackability, so that a cost cut for the sheet stacking member 28 can be achieved.

Figure 8:
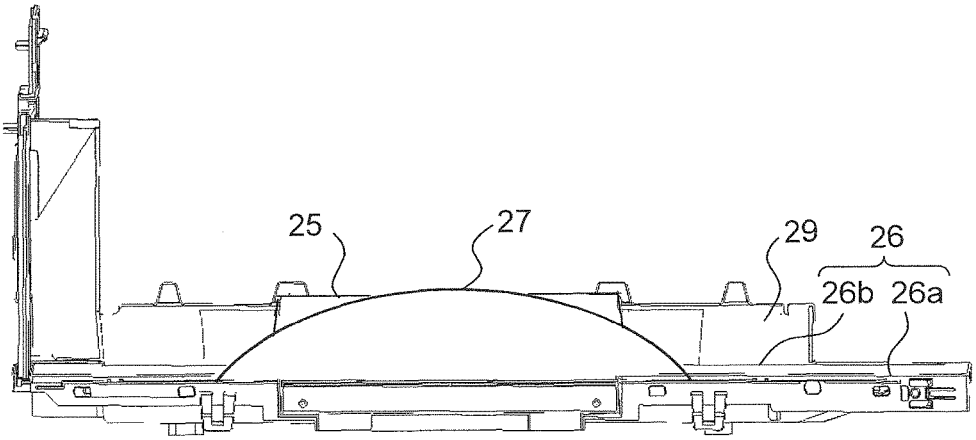
FIG. 8 is a side view of a sheet discharge tray according to another embodiment of the disclosure as viewed from the downstream side in the discharge direction

In addition, the second stacking portion 27 does not necessarily need to be generally horizontal, and may be formed so as to have a smaller upgrade along the discharge direction as compared with the first stacking portion 25. Although the second stacking portion 27 in the above embodiment has the sloped surfaces 27*b* formed at widthwise both-end portions of the generally horizontal sheet stacking surface 27*a*, yet the second stacking portion 27 may also be formed into a circular shape as viewed in the discharge direction, as shown in FIG. 8.

In addition to the above description, the present disclosure is not limited to the above-described embodiment and may be changed and modified in various ways unless such changes and modifications depart from the gist of the disclosure. The sheet discharge tray 24 to be used for the in-body sheet discharge type image forming apparatus 100 has been described in the foregoing embodiment. However, the disclosure is also applicable, entirely similarly, to a sheet discharge tray provided on the top surface or side surface of the image forming apparatus 100, a document discharge tray for discharging a document conveyed to the image reading part 8 by the document conveyance unit 3 and subjected to reading of the document image, or a sheet discharge tray provided in a sheet postprocessing device for performing punch-hole formation process or binding process with sheets having been subjected to image formation process.

This disclosure is applicable to a sheet discharge tray which is mounted on an image forming apparatus to hold discharged sheets. By application of the disclosure, there can be provided a sheet discharge tray, as well as an image forming apparatus including the sheet discharge tray, capable of correctly stacking a discharged sheet in position regardless of the type of the sheet.

What is claimed is:

1. A sheet stacking tray comprising a first stacking portion which is placed on an upstream side in a sheet discharge direction and which has an upgrade along the sheet discharge direction;

a second stacking portion which extends from the first stacking portion toward the downstream side in the discharge-direction and which is horizontal or has an upgrade smaller than that of the first stacking portion along the sheet discharge direction; and a base portion in which the first stacking portion and the second stacking portion are provided, wherein in a sheet widthwise direction perpendicular to the sheet discharge direction, the first stacking portion includes a first sheet stacking surface having a first stacking width (w1) within a range from one half of a sheet width of a maximum-size sheet to be discharged up to the sheet width of the maximum-size sheet, the first sheet stacking surface being generally horizontal to the sheet widthwise direction, and the second stacking portion includes a second sheet stacking surface having a second stacking width (w2) smaller than the first stacking width, the second sheet stacking surface being generally horizontal to the sheet widthwise direction, and sloped surfaces which are sloped downward from widthwise both-end edges of the second sheet stacking surface, a sheet-widthwise length of the second stacking portion containing the second sheet stacking surface plus the sloped surfaces is generally equal to a sheet-widthwise length of the first stacking portion containing the first sheet stacking surface, and the first sheet stacking surface has side portions in the widthwise direction, both side portions are coupled, with a downward slope, toward the sloped surfaces at a downstream-side end portion in the sheet discharge direction so as form a bent shape bent in an inverted V-shape as seen from the sheet widthwise direction.

2. The sheet stacking tray according to claim 1, wherein the second stacking portion has an upwardly-convexed circular-arc shape as viewed in the sheet discharge direction.

3. The sheet stacking tray according to claim 1, further comprising a rear wall portion which is provided on the discharge-direction upstream side of the first stacking portion and against which a rear end portion of a sheet stacked on the sheet stacking part is thrust and aligned, wherein a distance from the rear wall portion to the border between the first stacking portion and the second stacking portion is equal to or less than one half of a discharge-direction length of a maximum-size sheet stackable on the sheet stacking part.

4. The sheet stacking tray according to claim 1, wherein the base portion includes a flat part on which the first stacking portion and the second stacking portion are provided, and a base end portion which is coupled with a discharge-direction upstream side of the first stacking portion and which is inclined under the flat part, and the base end portion has a sheet-widthwise length equal to or more than a maximum width of a sheet to be stacked on the sheet stacking tray.

5. The sheet stacking tray according to claim 1, wherein the first stacking portion is integrally formed with the second stacking portion and fittable to and removable from the base portion along with the second stacking portion.

6. A sheet postprocessing device comprising:

the sheet stacking tray according to claim 1; and a sheet discharge part for discharging a sheet onto the sheet stacking tray.

7. An image forming apparatus comprising:

an image forming part for forming an image on a sheet;

the sheet stacking tray according to claim 1; and a sheet discharge part for discharging the sheet, on which an image has been formed in the image forming part, to the sheet stacking tray.

8. The image forming apparatus according to claim 7, further comprising a corrugation member provided in the sheet discharge part to press a top surface of a sheet discharged from the sheet discharge part and thereby impart stiffness to the sheet.

* * * * *